US010037046B1

(12) United States Patent
Kadanka

(10) Patent No.: US 10,037,046 B1
(45) Date of Patent: Jul. 31, 2018

(54) REGULATING TEMPERATURE-COMPENSATED OUTPUT VOLTAGE

(71) Applicant: SEMICONDUCTOR COMPONENTS INDUSTRIES, LLC, Phoenix, AZ (US)

(72) Inventor: Petr Kadanka, Valasska Bystrice (CZ)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 15/690,818

(22) Filed: Aug. 30, 2017

Related U.S. Application Data

(60) Provisional application No. 62/472,391, filed on Mar. 16, 2017.

(51) Int. Cl.

| | |
|---|---|
| ***G05F 3/30*** | (2006.01) |
| ***G05F 1/567*** | (2006.01) |
| ***G05F 1/46*** | (2006.01) |
| ***G05F 1/575*** | (2006.01) |

(52) U.S. Cl.
CPC ..... *G05F 1/567* (2013.01); *G05F 1/468* (2013.01); *G05F 1/575* (2013.01)

(58) Field of Classification Search
None
See application file for complete search history.

(56) References Cited

U.S. PATENT DOCUMENTS 7,408,400 B1 * 8/2008 DeStasi ..... G05F 3/30 323/313

OTHER PUBLICATIONS

Brokaw, "A Simple Three-Terminal IC Bandgap Reference," IEEE Journal of Solid-State Circuits, Vo. SC-9, No. 6, Dec. 1974, pp. 388-393.

* cited by examiner

*Primary Examiner* — Jeffrey Zweizig
(74) *Attorney, Agent, or Firm* — Dan Krueger; Ramey & Schwaller, LLP

(57) ABSTRACT

A low-voltage bandgap reference circuit includes a current source supplying a reference voltage rail. The circuit further includes a $V_{be}$ loop branch coupled to the reference voltage rail to obtain a $V_{be}$ voltage with a negative temperature coefficient. The circuit further includes a $\Delta V_{be}$ loop branch to obtain a $\Delta V_{be}$ voltage, the $\Delta V_{be}$ loop branch employing a fractional $V_{be}$ voltage, to provide a reduced, positive temperature coefficient. The circuit further includes a feedback amplifier that sets identical voltages from the loop branches on inputs of the amplifier A to regulate an output voltage of the circuit on the reference voltage rail at a temperature-compensated value below 1.2V.

20 Claims, 4 Drawing Sheets

REGULATING TEMPERATURE-COMPENSATED OUTPUT VOLTAGE

CROSS-REFERENCE TO RELATED APPLICATION

This application claims the benefit of U.S. Provisional Application No. 62/472,391, titled "Low Voltage Bandgap Reference Circuit and Method" and filed Mar. 16, 2017.

BACKGROUND

A voltage reference is typically provided by electronic circuitry that outputs a constant voltage despite variations in temperature or power supply that might normally or otherwise cause voltage fluctuations. As a result, the desired behavior is that the voltage reference remains constant even as conditions in the system vary. Such voltage references may be used in power supply voltage regulators, analog-to-digital converters, digital-to-analog converters, and the like as well as many other measurement and control systems.

Almost all integrated circuit devices require a precise voltage reference. One implementation is known as the Brokaw voltage reference, which generally provides a voltage reference between 1.2 and 1.3 V (i.e., about 1.25 V) and consequently necessitates a slightly higher input voltage (e.g., about 1.4 V). However, integrated circuit devices that require voltage references lower than 1.2 V, such as those in mobile applications, are not compatible with the Brokaw voltage reference.

Previous attempts have been made to provide suitable low voltage references such as the depletion NMOS voltage reference. However, such low voltage references have much higher spread due to manufacturing variations, and trimming is required to obtain the desired precision. Trimming is expensive in terms of die area, equipment, and test time.

SUMMARY

Accordingly, to provide such low voltage references, regulating temperature-compensated output voltage is disclosed herein. A low-voltage bandgap reference circuit includes a current source supplying a reference voltage rail. The circuit further includes a $V_{be}$ loop branch coupled to the reference voltage rail to obtain a $V_{be}$ voltage with a negative temperature coefficient. The circuit further includes a $\Delta V_{be}$ loop branch to obtain a $\Delta V_{be}$ voltage, the $\Delta V_{be}$ loop branch employing a fractional $V_{be}$ voltage, to provide a reduced, positive temperature coefficient. The circuit further includes a feedback amplifier that sets identical voltages from the loop branches on inputs of the amplifier to regulate an output voltage of the circuit on the reference voltage rail at a temperature-compensated value below 1.2V.

An integrated circuit device includes a package and pins coupled to the package. The device further includes a low-voltage bandgap reference circuit, housed by the package, including a $V_{be}$ loop branch coupled to a reference voltage rail to obtain a $V_{be}$ voltage with a negative temperature coefficient. The circuit further includes a $\Delta V_{be}$ loop branch to obtain a $\Delta V_{be}$ voltage, the $\Delta V_{be}$ loop branch employing a fractional $V_{be}$ voltage, to provide a reduced, positive temperature coefficient. The circuit further includes a feedback amplifier that sets identical voltages from the loop branches on inputs of the amplifier to regulate an output voltage of the circuit on the reference voltage rail at a temperature-compensated value below 1.2V.

A semiconductor apparatus includes a semiconductor wafer and circuits formed in or on the wafer. Each circuit includes a $V_{be}$ loop branch coupled to a reference voltage rail to obtain a $V_{be}$ voltage with a negative temperature coefficient. Each circuit further includes a $\Delta V_{be}$ loop branch to obtain a $\Delta V_{be}$ voltage, the $\Delta V_{be}$ loop branch employing a fractional $V_{be}$ voltage, to provide a reduced, positive temperature coefficient. Each circuit further includes a feedback amplifier that sets identical voltages from the loop branches on inputs of the amplifier to regulate an output voltage of the circuit on the reference voltage rail at a temperature-compensated value below 1.2V.

BRIEF DESCRIPTION OF THE DRAWINGS

In the following detailed description of the various disclosed embodiments, reference will be made to the accompanying drawings in which.

Figure 1:
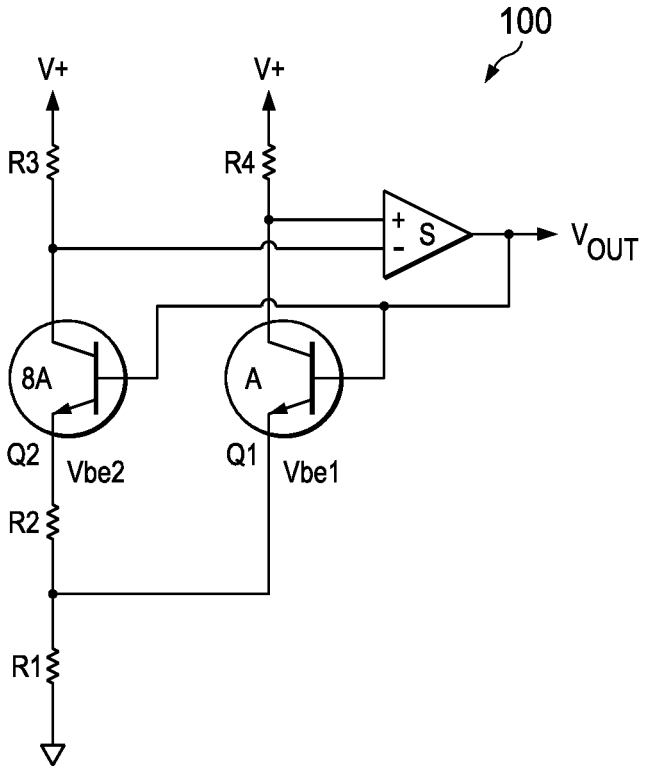
FIG. 1 (PRIOR ART)
FIG. 1 is a circuit diagram of a prior art circuit.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

Notation and Nomenclature

Certain terms are used throughout the following description and claims to refer to particular system components and configurations. As one of ordinary skill will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ". Also, the term "couple" or "couples" is intended to mean either an indirect or a direct electrical or physical connection. Thus, if a first device couples to a second device, that connection may be through a direct electrical connection, through an indirect electrical connection via other devices and connections, through a direct physical connection, or through an indirect physical connection via other devices and connections in various embodiments.

DETAILED DESCRIPTION

The issues identified in the background are at least partly addressed by circuits and devices that regulate temperature-compensated output voltage. The circuits and devices proposed herein are improvements on the Brokaw reference circuits, such as the Brokaw reference circuit 100 illustrated in FIG. 1. The circuit 100 includes two transistors, Q1 and Q2; four resistors, R1, R2, R3, and R4; and a feedback amplifier, S. Here, Q2 has an emitter area eight times larger than Q1 as noted by the labels A and 8A. In other embodiments, Q2 has an emitter area N times larger than Q1 where N is any natural number bigger than 1. When the voltage at their common base is small, such that the voltage drop across R2 is small, the larger area of Q2 causes Q2 to conduct more of the total current available through RE As such, Q2 requires a smaller base-emitter voltage for the same current. The base-emitter voltage for each transistor, $V_{be1}$ and $V_{be2}$, has a negative temperature coefficient (i.e., it decreases with temperature). The difference between the two base-emitter voltages, ΔVbe, has a positive temperature coefficient (i.e., it increases with temperature).

The amplifier S uses negative feedback to force a constant current through the two transistors, Q1 and Q2. The resulting imbalance in collector voltages drives the amplifier S, which raises the base voltage. Alternatively, if the base voltage is high, forcing a large current through R1, the voltage across R2 will limit the current through Q2 so that the current through Q2 will be less than the current through Q1. Accordingly, the collector voltage imbalance will be reversed, causing the amplifier S to reduce the base voltage. Between these two extreme conditions is a base voltage at which the two collector currents match, toward which the amplifier S drives from any other condition. This will occur when the emitter current densities are in the ratio 8-to-1, the emitter area ratio.

When this difference in current density has been produced by the amplifier S, $\Delta V_{be}$ will appear across R2. This difference is given by:

$$\Delta Vbe = \frac{kT}{q}\ln\frac{J_1}{J_2} \tag{1}$$

where k is the Boltzmann constant (1.38 e−23 $J^*K^{-1}$), q is the electron charge (1.602 e−19 C), and T is the absolute temperature (Kelvin). Because the current through Q1 is equal to the current through Q2, the current through R1 is twice that through R2 and the voltage across R1 is given by:

$$V_{R1} = 2\frac{R_1}{R_2}\frac{kT}{q}\ln\frac{J_1}{J_2} \tag{2}$$

Assuming the resistor ratio and current density ratio are invariant, the voltage across R1 varies directly with T, the absolute temperature. The voltage at the base of Q1 is the sum of $V_{be1}$ and the temperature-dependent voltage across $R_1$. Accordingly, the circuit 100 output, $V_{OUT}$, is the sum of: 1) the base-emitter voltage difference (ΔVbe) and 2) one of the base-emitter voltages ($V_{be1}$ or $V_{be2}$).

In this circuit 100 and other Brokaw reference circuits, $V_{OUT}$ is regulated to about 1.25 V (i.e., anywhere from 1.2 V to 1.3 V). However, integrated circuit devices increasingly require voltage references lower than 1.2 V, which cannot be provided by the circuit 100, but which can be provided by the circuits illustrated in FIGS. 2 and 3.

Figure 2:
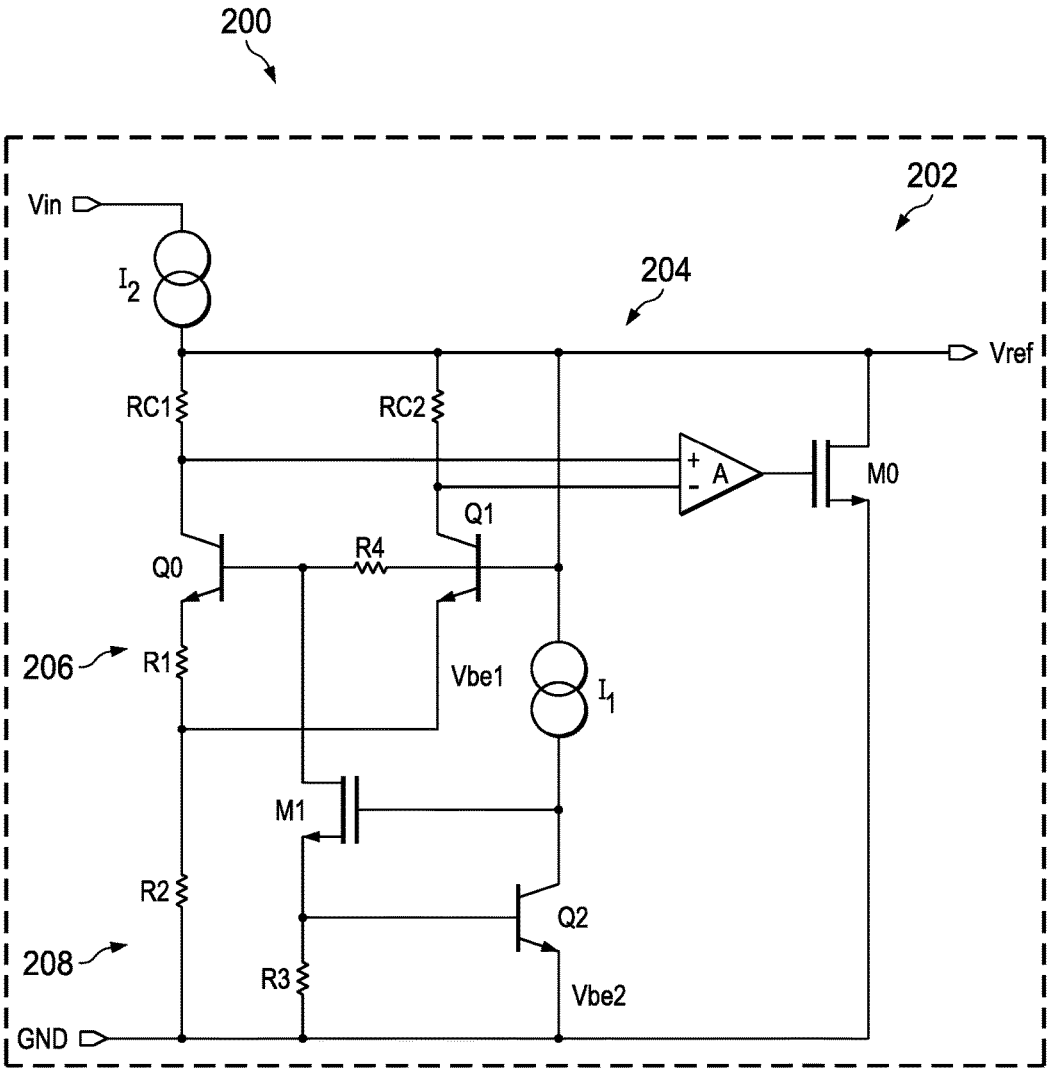
FIG. 2 is a circuit diagram of an illustrative circuit that regulates temperature-compensated output voltage.

FIG. 2 illustrates a circuit 202 that regulates temperature-compensated output voltage, $V_{ref}$, to less than 1.2 V. The circuit 202 may be part of a larger circuit, part of an integrated circuit device, formed on a semiconductor wafer, and the like as represented by dashed rectangle 200. The circuit 202 includes three bipolar junction transistors ("BJTs"), Q0, Q1, and Q2; two metal-oxide semiconductor field-effect transistors ("MOSFETs"), M0 and M1; six resistors, R1, R2, R3, R4, RC1, and RC2; two current sources, $I_1$ and $I_2$, and a feedback amplifier, A. The amplifier A keeps identical current through transistors Q0 and Q1 by sensing voltages on bottom terminals of resistors RC1 and RC2. The amplifier sets zero voltage between its inputs using the feedback loop through M0. Because the upper terminals of RC1 and RC2 are tied together, there are identical voltages across RC1 and RC2 resulting in identical currents through RC1 and RC2 (and consequently identical current through Q0 and Q1). In at least one embodiment, M1 is a depletion negative MOSFET ("NMOS") transistor or low Vth NMOS, and M0 is an NMOS or BJT.

The current source $I_2$ supplies a reference voltage rail 204, and the circuit 202 includes a loop branch 206 coupled to the reference voltage rail 204. This branch 206 obtains the base-emitter voltage of Q1, $V_{be1}$, which has a negative temperature coefficient. The circuit also includes a $\Delta V_{be}$ loop branch 208. This branch obtains a voltage including the voltage difference from the base-emitter voltages of Q1 and Q2 as described above, but also including a fractional base-emitter voltage of Q2, $V_{be2}$. This fractional voltage enables a reduced positive temperature-coefficient. The fractional $V_{be2}$ voltage may be created on resistor R4. While resistances may be sensitive to process variation, their ratios generally remain quite precise. As such, the circuit 200 employs a resistor ratio of R4 to R3 to set the fraction of $V_{be2}$ that is incorporated into the $\Delta V_{be}$ loop. In this way, temperature compensation for output voltages lower than 1.25 V and/or 1.2 V may be achieved. Specifically, the feedback amplifier A sets identical voltages from the loop branches on inputs of the amplifier to regulate an output voltage of the circuit on the reference voltage rail at a temperature-compensated value below 1.2V. For example, the feedback amplifier A combines the $V_{be1}$ voltage with the reduced $\Delta V_{be}$ voltage to regulate the output voltage $V_{ref}$ at a temperature-compensated value below 1.25 V and/or 1.2 V. Such regulation may be performed without trimming and with an accuracy better than ±1%. Specifically, the output voltage may be given by:

$$Vref = 2\left(\frac{R_2}{R_1}\right)\left(\frac{kT}{q}\right)\ln N + V_{be1} - 2(V_{be2})\left(\frac{R_4}{R_3}\right)\left(\frac{R_2}{R_1}\right) \tag{3}$$

where $$V_T = \frac{kT}{q}.$$

As indicated by equation (3), the output voltage may be set by balancing four resistors, R1, R2, R3, and R4. The input voltage of the circuit may be higher than the output voltage by less than 10 millivolts.)

Figure 3:
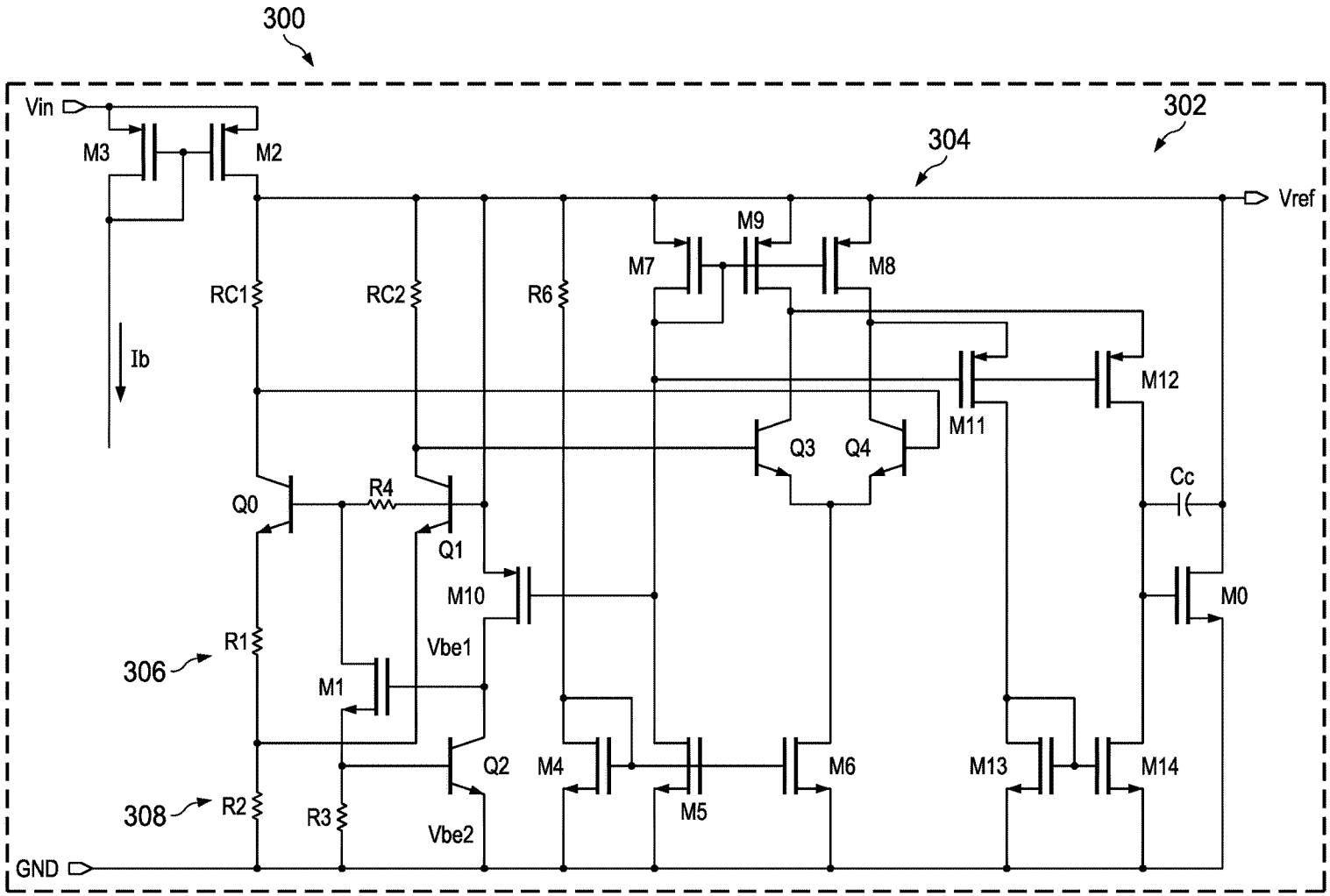
FIG. 3 is a circuit diagram of another illustrative circuit that regulates temperature-compensated output voltage.

FIG. 3 illustrates a circuit 302 that regulates temperature-compensated output voltage, $V_{ref}$, to less than 1.2 V. The circuit 302 may be part of a larger circuit, part of an integrated circuit device, formed on a semiconductor wafer, and the like as represented by dashed rectangle 300. The circuit 302 includes five BJTs, Q0, Q1, Q2, Q3, and Q4; fifteen MOSFETs, M0, M1, M2, M3, M4, M5, M6, M7, M8, M9, M10, M11, M12, M13, and M14; eight resistors, R1, R2, R3, R4, R5, R6, RC1, and RC2; and one capacitor, $C_c$. The feedback amplifier is implemented by R6, Q3, Q4, M4, M6, M7, M8, M9, M11, M12, M13, M14, M0, and Cc.

The circuit 302 includes a loop branch 306 coupled to a reference voltage rail 304. This branch 306 obtains a voltage, $V_{be1}$, with a negative temperature coefficient as described above. The circuit also includes a $\Delta V_{be}$ loop branch 308. This branch obtains a $\Delta V_{be}$ voltage as described above, using a fractional $V_{be2}$ voltage to provide a reduced, positive temperature-coefficient. The fractional $V_{be2}$ voltage may be created on resistor R4, using the resistor ratio R4 to R3 as described above. Specifically, $$\Delta V_{be} = V_T * \ln(N) - V_{be2}\left(\frac{R_4}{R_3}\right) \tag{4}$$

where N is the ratio of emitter areas between Q0 and Q1. Accordingly, the output voltage is given by:

$$Vref = 2\left(V_T * \ln(N) - V_{be2}\left(\frac{R_4}{R_3}\right)\right)\left(\frac{R_2}{R_1}\right) + V_{be1} \text{ or} \tag{5}$$

$$Vref = 2\left(\frac{R_2}{R_1}\right)V_T * \ln(N) + V_{be1} - 2V_{be2}\left(\frac{R_4}{R_3}\right)\left(\frac{R_2}{R_1}\right) \tag{6}$$

As indicated by equations (5) and (6), the output voltage may be set by balancing four resistors, R1, R2, R3, and R4. The input voltage of the circuit may be higher than the output voltage by less than 10 millivolts.

Figure 4:
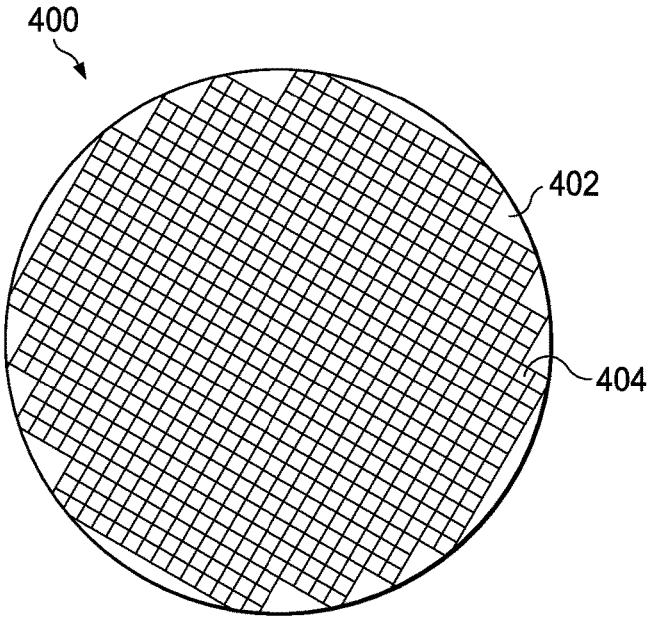
FIG. 4 is a top-view of an illustrative semiconductor apparatus including a semiconductor wafer.

FIG. 4 is a top-view of an illustrative semiconductor apparatus 400 including a semiconductor wafer 402. The wafer 402, also called a slice or substrate, is a thin slice of semiconductor material, such as a crystalline silicon, used in electronics for the fabrication of integrated circuits. The wafer 402 serves as the substrate for circuits 404 built in and over the wafer 402 and undergoes many microfabrication process steps such as doping or ion implantation, etching, deposition of various materials, and photolithographic patterning. The circuits 404 may be the circuits 202, 302 discussed above with respect to FIGS. 2 and 3, and the wafer 402 may be represented by the dashed rectangles 200, 300. After such processes, the individual circuits 404 are separated and packaged as illustrate in FIG. 5.

Figure 5:
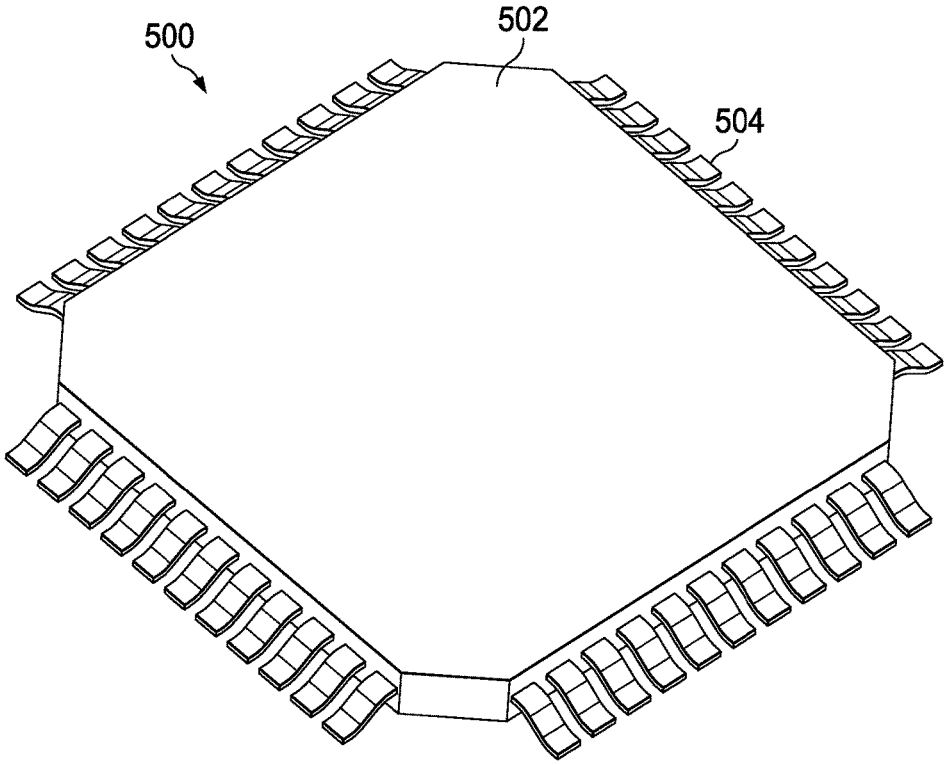
FIG. 5 is a perspective view of an illustrative integrated circuit device including a package and pins.

FIG. 5 is a perspective view of an illustrative integrated circuit device 500 including a package 502 and pins 504 coupled to the package 502. The package 502 may house circuits 202, 302 discussed above with respect to FIGS. 2 and 3, and the package 502 may be represented by the dashed rectangles 200, 300. Packaging is the final stage of semiconductor device fabrication, in which the circuit is encapsulated in a supporting package 502 that prevents physical damage and corrosion. The package 502 supports the pins 504, which connect the device 500 to a circuit board. Packages may be single in-line packages ("SIPs"), dual in-line packages ("DIPs"), ceramic DIPs, glass sealed DIPs, quadruple in-line packages ("QIPs"), skinny DIPs, zig-zag in-line packages ("ZIPs"), molded DIPs, plastic DIPs, and the like.

In some aspects systems, devices, and methods for regulating temperature-compensated output voltage are provided according to one or more of the following examples:

Example 1

A low-voltage bandgap reference circuit includes a current source supplying a reference voltage rail. The circuit further includes a $V_{be}$ loop branch coupled to the reference voltage rail to obtain a $V_{be}$ voltage with a negative temperature coefficient. The circuit further includes a $\Delta V_{be}$ loop branch to obtain a $\Delta V_{be}$ voltage, the $\Delta V_{be}$ loop branch employing a fractional $V_{be}$ voltage, to provide a reduced, positive temperature coefficient. The circuit further includes a feedback amplifier that sets identical voltages from the loop branches on inputs of the amplifier to regulate an output voltage of the circuit on the reference voltage rail at a temperature-compensated value below 1.2V.

Example 2

An integrated circuit device includes a package and pins coupled to the package. The device further includes a low-voltage bandgap reference circuit, housed by the package, including a $V_{be}$ loop branch coupled to a reference voltage rail to obtain a $V_{be}$ voltage with a negative temperature coefficient. The circuit further includes a $\Delta V_{be}$ loop branch to obtain a $\Delta V_{be}$ voltage, the $\Delta V_{be}$ loop branch employing a fractional $V_{be}$ voltage, to provide a reduced, positive temperature coefficient. The circuit further includes a feedback amplifier that sets identical voltages from the loop branches on inputs of the amplifier to regulate an output voltage of the circuit on the reference voltage rail at a temperature-compensated value below 1.2V.

Example 3

A semiconductor apparatus includes a semiconductor wafer and circuits formed in or on the wafer. Each circuit includes a $V_{be}$ loop branch coupled to a reference voltage rail to obtain a $V_{be}$ voltage with a negative temperature coefficient. Each circuit further includes a $\Delta V_{be}$ loop branch to obtain a $\Delta V_{be}$ voltage, the $\Delta V_{be}$ loop branch employing a fractional $V_{be}$ voltage, to provide a reduced, positive temperature coefficient. Each circuit further includes a feedback amplifier that sets identical voltages from the loop branches on inputs of the amplifier to regulate an output voltage of the circuit on the reference voltage rail at a temperature-compensated value below 1.2V.

The following features may be incorporated into the various embodiments described above, such features incorporated either individually in or conjunction with one or more of the other features. The output voltage may be regulated on the reference voltage rail at the temperature-compensated value below 1.2V without trimming. The output voltage may be regulated on the reference voltage rail at the temperature-compensated value below 1.2V with an accuracy better than ±1%. The $\Delta V_{be}$ voltage may be a difference in base-emitter voltages of two transistors reduced by the fractional $V_{be}$ voltage. The fractional $V_{be}$ voltage may be created on a resistor, and the value of the fractional $V_{be}$ voltage may be given by a ratio of the resistor and another resistor. The output voltage may be set by balancing four resistors. The output voltage may be given by $$2\left(\frac{R_2}{R_1}\right)V_T \ln N + V_{be1} - 2(V_{be2})\left(\frac{R_4}{R_3}\right)\left(\frac{R_2}{R_1}\right).$$

An input voltage may be higher than the output voltage by less than 10 millivolts.

Numerous other modifications, equivalents, and alternatives, will become apparent to those skilled in the art once the above disclosure is fully appreciated. It is intended that the following claims be interpreted to embrace all such modifications, equivalents, and alternatives where applicable.

What is claimed is:

1. A low-voltage bandgap reference circuit comprising:

a current source supplying a reference voltage rail;

a $V_{be}$ loop branch coupled to the reference voltage rail to obtain a $V_{be}$ voltage with a negative temperature coefficient;

a $\Delta V_{be}$ loop branch to obtain a $\Delta V_{be}$ voltage, the $\Delta V_{be}$ loop branch employing a fractional $V_{be}$ voltage, to provide a reduced, positive temperature coefficient;

a feedback amplifier that sets identical voltages from the loop branches on inputs of the amplifier to regulate an output voltage of the circuit on the reference voltage rail at a temperature-compensated value below 1.2V.

2. The circuit of claim 1, wherein the output voltage is regulated on the reference voltage rail at the temperature-compensated value below 1.2V without trimming.

3. The circuit of claim 1, wherein the output voltage is regulated on the reference voltage rail at the temperature-compensated value below 1.2V with an accuracy better than ±1%.

4. The circuit of claim 1, wherein the $\Delta V_{be}$ voltage is a difference in base-emitter voltages of two transistors reduced by the fractional $V_{be}$ voltage.

5. The circuit of claim 1, wherein the fractional $V_{be}$ voltage is created on a resistor, and the value of the fractional $V_{be}$ voltage is given by a ratio of the resistor and another resistor.

6. The circuit of claim 1, wherein the output voltage may be set by balancing four resistors.

7. The circuit of claim 1, wherein the output voltage is given by $$2\left(\frac{R_2}{R_1}\right)V_T \ln N + V_{be1} - 2(V_{be2})\left(\frac{R_4}{R_3}\right)\left(\frac{R_2}{R_1}\right).$$

8. The circuit of claim 1, wherein an input voltage of the circuit is higher than the output voltage by less than 10 millivolts.

9. An integrated circuit device comprising:

a package;

pins coupled to the package; and a low-voltage bandgap reference circuit, housed by the package, comprising:

a $V_{be}$ loop branch coupled to a reference voltage rail to obtain a $V_{be}$ voltage with a negative temperature coefficient;

a $\Delta V_{be}$ loop branch to obtain a $\Delta V_{be}$ voltage, the $\Delta V_{be}$ loop branch employing a fractional $V_{be}$ voltage, to provide a reduced, positive temperature coefficient;

a feedback amplifier that sets identical voltages from the loop branches on inputs of the amplifier to regulate an output voltage of the circuit on the reference voltage rail at a temperature-compensated value below 1.2V.

10. The device of claim 9, wherein the output voltage is regulated on the reference voltage rail at the temperature-compensated value below 1.2V without trimming.

11. The device of claim 9, wherein the output voltage is regulated on the reference voltage rail at the temperature-compensated value below 1.2V with an accuracy better than ±1%.

12. The device of claim 9, wherein the $\Delta V_{be}$ voltage is a difference in base-emitter voltages of two transistors reduced by the fractional $V_{be}$ voltage.

13. The device of claim 9, wherein the fractional $V_{be}$ voltage is created on a resistor, and the value of the fractional $V_{be}$ voltage is given by a ratio of the resistor and another resistor.

14. The device of claim 9, wherein the output voltage may be set by balancing four resistors.

15. The device of claim 9, wherein the output voltage is given by $$2\left(\frac{R_2}{R_1}\right)V_T \ln N + V_{be1} - 2(V_{be2})\left(\frac{R_4}{R_3}\right)\left(\frac{R_2}{R_1}\right).$$

16. The device of claim 9, wherein an input voltage of the circuit is higher than the output voltage by less than 10 millivolts.

17. A semiconductor apparatus comprising:

a semiconductor wafer; and circuits formed in or on the wafer, each circuit comprising:

a $V_{be}$ loop branch coupled to a reference voltage rail to obtain a $V_{be}$ voltage with a negative temperature coefficient;

a $\Delta V_{be}$ loop branch to obtain a $\Delta V_{be}$ voltage, the $\Delta V_{be}$ loop branch employing a fractional $V_{be}$ voltage, to provide a reduced, positive temperature coefficient;

a feedback amplifier that sets identical voltages from the loop branches on inputs of the amplifier to regulate an output voltage of the circuit on the reference voltage rail at a temperature-compensated value below 1.2V.

18. The apparatus of claim 17, wherein the output voltage is regulated on the reference voltage rail at the temperature-compensated value below 1.2V with an accuracy better than ±1% without trimming.

19. The apparatus of claim 17, wherein the output voltage is regulated on the reference voltage rail at the temperature-compensated value below 1.2V with an accuracy better than ±1%.

20. The apparatus of claim 17, wherein the $\Delta V_{be}$ voltage is a difference in base-emitter voltages of two transistors reduced by the fractional $V_{be}$ voltage.

* * * * *